US006016419A

United States Patent [19]

Hirai

[11] Patent Number: 6,016,419

[45] Date of Patent: Jan. 18, 2000

[54] IMAGE FORMING APPARATUS

[75] Inventor: Atsuto Hirai, Ikoma, Japan

[73] Assignee: Minolta Co., Ltd., Osaka, Japan

[21] Appl. No.: 09/144,992

[22] Filed: Sep. 1, 1998

[30] Foreign Application Priority Data

Sep. 3, 1997 [JP] Japan ..... 9-238070

[51] Int. Cl.[7] ..... G03G 15/00

[52] U.S. Cl. ..... 399/390; 399/297

[58] Field of Search ..... 399/233, 237, 399/296, 297, 299, 300, 306, 340, 341, 390

[56] References Cited

U.S. PATENT DOCUMENTS

| | | | |
|---|---|---|---|
| 4,777,509 | 10/1988 | Komatsubara et al. | 399/233 X |
| 5,040,027 | 8/1991 | Nankou et al. | 399/390 |
| 5,099,281 | 3/1992 | Bhagat | 399/390 X |
| 5,153,652 | 10/1992 | Zoltner | 399/390 |
| 5,374,980 | 12/1994 | Kubo et al. | 399/233 |
| 5,434,657 | 7/1995 | Berkes et al. | 399/297 X |
| 5,558,970 | 9/1996 | Landa et al. | 399/296 X |
| 5,627,632 | 5/1997 | Staudenmayer et al. | 399/296 |
| 5,826,145 | 10/1998 | Fukae | 399/233 |

FOREIGN PATENT DOCUMENTS

| | | |
|---|---|---|
| 8-152788 | 6/1996 | Japan . |
| 8-297418 | 11/1996 | Japan . |

*Primary Examiner*—Sandra Brase
*Attorney, Agent, or Firm*—Burns, Doane, Swecker & Mathis, LLP

[57] ABSTRACT

An image forming apparatus including an image holding device for holding on its surface an image developed with liquid developer; a record medium transporting device for transporting a record medium from a supply position to a transfer position for transferring the image developed on the image holding device onto a surface of the record medium; and a transfer agent supply device for supplying a transfer agent for providing a good transferred image onto the above surface of the record medium during transportation between the supply position and the transfer position.

24 Claims, 6 Drawing Sheets

IMAGE FORMING APPARATUS

This application is based on patent application No. 9-238070 Pat. filed in Japan, the contents of which is hereby incorporated by reference.

BACKGROUND OF THE INVENTION

1. Field of the Invention

The present invention relates to an image forming apparatus such as a copying machine or a printer, in which an image developed with liquid developer and held on an image holding device is transferred onto a record medium.

2. Description of the Background Art

In an image forming apparatus such as a copying machine or a printer, image formation with liquid developer is generally performed as follows. A surface of an electrostatic latent image carrier such as a photosensitive member is charged, and image exposure based on image information is effected on the charged region to form an electrostatic latent image. The latent image thus formed is developed into a visible toner image with liquid developer, and the visible toner image is transferred onto a record medium such as a paper sheet.

For forming a color image with liquid developers, electrostatic latent images corresponding to various colors (e.g., cyan, magenta, yellow and black in the case of formation of a full color image) are successively formed on an electrostatic latent image carrier based on the image information. When the electrostatic latent image corresponding to one of the colors is formed, the visible toner image of the same color is then formed by developing the latent image with the liquid developer of the same color, and is transferred onto the record medium. In this manner, the transferred toner images of the respective colors are superposed on the record medium. The multi-layered toner image thus formed are generally fixed to a transferred image receiver under a heat and a pressure.

If fast formation of the color image is required, an image forming apparatus of a so-called tandem type may be employed. In the image forming apparatus of this tandem type, a plurality of units for forming and transferring visible toner images of different colors are successively arranged along a certain direction. The record medium is passed successively through visible image transfer portions in the above visible toner image forming and transferring units. A transporting member is employed for holding the record medium and successively passing the same through the transfer portions as described above.

In any kind of the wet image forming apparatuses using the liquid developer, a quantity of carrier liquid, which is adhered onto the image carrier together with the toner image, forms an important factor determining the result of the process for transferring the developed toner image formed on the electrostatic latent image carrier onto the record medium. More specifically, the following problems may arise depending on the quantity of the carrier liquid.

For example, the apparatus may employ transferring means which forms a transfer electric field for attracting the toner onto the transferred image receiver. In this case, the toner on the image carrier electrically migrates to the transferred image receiver through the carrier liquid coexisting with the toner. If the quantity of the carrier liquid is excessively small, the electrical migration (electrophoresis) and therefore the transfer cannot be performed sufficiently, resulting in lowering of an image density and/or variations in density. If the quantity of the carrier liquid is excessively large, the carrier liquid tends to overflow from the transfer portion, which is formed between the electrostatic latent image carrier and the transferred image receiver, and thereby may push out the toner on the electrostatic latent image carrier so that disturbance (i.e., a so-called image-flow) may occur in the image.

The transferred image receiver may be made of a liquid absorbent material such as paper. In this case, even if an appropriate quantity of carrier liquid coexisting with the toner image on the electrostatic latent image carrier is moved to the transfer portion, the carrier liquid in the transfer portion is absorbed into the transferred image receiver so that the quantity of the carrier liquid changes.

If the transferred image receiver is made of, e.g., MUCOAT 84 mg/m$^3$ manufactured by Komine Co., Ltd., the appropriate quantity of the carrier liquid to be moved into the transfer portion is 0.1 mg/cm$^2$. Meanwhile, if KOMINE 64 g/m$^3$ manufactured by Komine Co., Ltd. is used, the required quantity of the carrier liquid to be moved into the transfer portion is 0.6 mg/cm$^2$.

In addition to the liquid absorptance of the transferred image receiver, the appropriate quantity of the carrier liquid in the transfer portion also depends on a surface roughness of the transferred image receiver. The surface of a large roughness has many and/or large concavities, which must be filled with the carrier liquid for performing the electrical migration required for intended transfer.

In the color image forming apparatus of the foregoing tandem type, if the transferred image receiver is made of a liquid absorbent material, the transferred image receiver absorbs the carrier liquid during the process of transferring the toner image of a first color, and thereby may be completely or nearly saturated with the carrier liquid. In this case, the transferred image receiver absorbs no or substantially no carrier liquid in the process of transferring the toner images of the second and subsequent colors. Accordingly, the quantity of the carrier liquid of the first color, which is absorbed into the transferred image receiver, is different from those in operations of transferring the toner images of the second and subsequent colors, and the quantities of the carrier liquid must be controlled depending on the colors, respectively. Further, a similar situation also occurs if the transferred image receiver has a large surface roughness. In this case, the quantity of the carrier liquid must be enough to fill the concavities on the surface of the transferred image receiver in the transfer operation for the first color, and the appropriate quantities of the carrier liquid for the second and subsequent colors are small because the concavities on the surface of the transferred image receiver are already filled with the carrier liquid.

In view of the above, the quantity of the carrier liquid moved to the transfer portion must be controlled depending on the kind of the transferred image receiver.

Japanese Laid-Open Patent Publication No. 8-297418 (297418/1996) has disclosed a manner for moving an appropriate quantity of carrier liquid to the transfer portion. In the disclosed manner, surplus carrier liquid is removed by squeezing means after an electrostatic latent image on an electrostatic latent image carrier was developed into a visible toner image, and conditions for squeezing and removing the carrier liquid are controlled in accordance with the kind of the transferred image receiver. For example, in the structure employing a squeeze roller, a space between the squeeze roller and a photosensitive member is controlled and/or a peripheral speed of the squeeze roller with respect to the photosensitive member is controlled. In the structure employing a squeeze charger, a voltage applied to the squeeze charger is controlled to change the quantity of carrier liquid which remains after squeezing.

In an image forming apparatus disclosed in Japanese Laid-Open Patent Publication No. 8-152788 (152788/1996), control is performed to determine a quantity of prewet liquid, which is applied onto a photosensitive member prior to development, in accordance with the kind of the transferred image receiver.

However, the image forming apparatus disclosed in Japanese Laid-Open Patent Publication No. 8-297418 requires a complicated structure which can change the squeezing conditions for removing the surplus carrier liquid by the squeezing means. If a large quantity of carrier liquid is required depending on a kind of the transferred image receiver, the control is performed to increase the quantity of the residual carrier liquid, which is not removed by squeezing and coexists with the toner on the photosensitive member. However, the residual carrier liquid contains many ions of the polarity opposite to the chargeable polarity of the toner. Thereby, the ions of the opposite polarity near the toner increase in quantity in accordance with increase in quantity of the carrier liquid. If the ions of the polarity opposite to the toner chargeable polarity are collected near the toner, the toner behaves as if the quantity of its charges lowers, and the electrophoresis of the toner in the transfer electric field formed in the transfer portion cannot sufficiently occur. Thereby, variations in image density are liable to occur in the toner image when it is transferred onto the transferred image receiver.

In the color image forming apparatus of the tandem type described above, the quantities of the residual carrier liquid must be controlled in view of the order in which the toner images of the respective colors are transferred, in addition to the control of the quantities of the residual carrier liquid under the conditions depending on the kinds of the transferred image receiver. Therefore, complicated control is required, resulting in increase in manufacturing cost of the image forming apparatus.

Further, in the image forming apparatus disclosed in Japanese Laid-Open Patent Publication No. 8-152788, the prewet liquid is applied onto the photosensitive member prior to the development. Therefore, the electrostatic latent image on the photosensitive member and a developing electrode in the region for developing the electrostatic latent image are spaced by a large distance, or the latent image and the toner are spaced by a large distance so that the developing speed decreases, and fast image formation cannot be performed. Further, such a problem arises that the prewet liquid is mixed into the liquid developer.

SUMMARY OF THE INVENTION

Accordingly, it is an object of the invention to provide a wet image forming apparatus, in which an image developed and formed on an image holding device with liquid developer is transferred onto a record medium, and particularly a wet image forming apparatus which can produce good transferred images regardless of kinds of the record media.

Another object of the invention is to provide a wet color image forming apparatus of a so-called tandem type, in which it is not necessary to give consideration to an order of transfer of toner images of respective colors, good transferred images can be produced regardless of kinds of the record media, and fast image formation can be performed.

According to one aspect of the invention, an image forming apparatus includes:

an image holding device for holding on its surface an image developed with liquid developer;

a record medium transporting device for transporting a record medium from a supply position to a transfer position for transferring the image developed on the image holding device onto a surface of the record medium; and a transfer agent supply device for supplying a transfer agent onto the above surface of the record medium during transportation between the supply position and the transfer position.

The image holding devices may be arranged at a plurality of positions, respectively, and the above transfer position may be determined correspondingly to each of the image holding devices. The record medium transporting device may be operable to pass the record medium successively through the plurality of transfer positions corresponding to the plurality of image holding devices, respectively. The transfer agent supply device may be arranged upstream, in a record medium transporting direction, to the most upstream transfer position.

The foregoing and other objects, features, aspects and advantages of the present invention will become more apparent from the following detailed description when taken in conjunction with the accompanying drawings.

DESCRIPTION OF THE PREFERRED EMBODIMENTS

Figure 1:
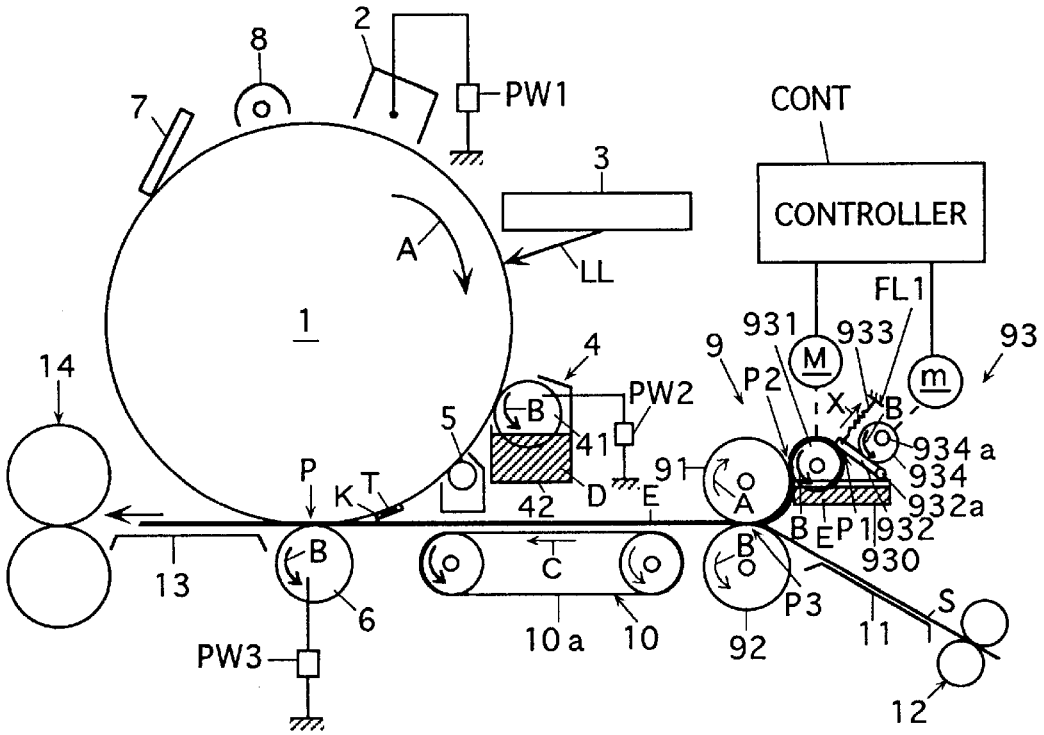
FIG. 1 shows a schematic structure of an example of a electrophotographic wet image forming apparatus according to the invention.

An image forming apparatus of an embodiment of the invention includes:

an image holding device for holding on its surface an image developed with liquid developer;

a record medium transporting device for transporting a record medium from a supply position to a transfer position for transferring the image developed on the image holding device onto a surface of the record medium; and a transfer agent supply device for supplying a transfer agent onto the above surface of the record medium during transportation between the supply position and the transfer position.

This image forming apparatus may be provided with a control device for controlling a quantity of the transfer agent supplied from the transfer agent supply device onto the record medium in accordance with a predetermined property (a liquid absorptance, a surface roughness and/or others) of the record medium.

The liquid developer usually contains medium liquid (carrier liquid) and toner.

The transfer agent to be supplied to the record medium may be typically transfer liquid (transfer control liquid), but is not restricted to the transfer liquid. In some cases, a kind of surfactant(surface active agent) or the like may be used.

The transfer liquid may be of the same kind as carrier liquid contained in the liquid developer used in this wet image forming apparatus, and may be liquid similar to the carrier liquid.

The liquid of the same kind as the carrier liquid may be IPS 1620 manufactured by Idemitsu Co., Ltd., although not restricted thereto. The liquid similar to the carrier liquid may be liquid having a viscosity similar to that of the carrier liquid in view of liquid absorption of the record medium. Liquid having a viscosity of about 1–2 cP (centipoises) may be used, although not restricted thereto.

The image holding device may be an electrostatic latent image carrier such as a photosensitive member which is usually employed in the image forming apparatus, and also may be an intermediate transfer member of an apparatus, in which an image is once transferred onto the intermediate transfer member, and then is transferred from the intermediate transfer member onto a record medium.

According to the above image forming apparatus, the transfer agent supply device supplies a transfer agent onto the surface of the record medium, onto which the image is to be transferred, prior to the transfer of the developed image formed on the image holding device onto the record medium. Thereby, the transferred image can have a good quality.

If transfer liquid is used as the transfer agent, the transfer liquid is absorbed into the record medium, and absorption of the liquid into the record medium will be suppressed thereafter. Thus, the image on the image holding device is transferred onto the record medium which has already absorbed the transfer liquid, and the record medium does not absorb the carrier liquid, which is adhered onto the image holding device and is a component of the liquid developer, or hardly absorbs the carrier liquid. Depending on the kind and properties (liquid absorptance, surface roughness and/or others) of the record medium, the quantity of the transfer liquid applied to the record medium is changed for applying the transfer liquid of the quantity required for good transfer, whereby a good transferred image can be formed on any kind of record medium in spite of the fact that the image holding device always carries a constant quantity of the carrier liquid.

The quantities of the transfer liquid depending on the kinds of the record media may be determined based on properties of standard record mediums to be used and, for example, based on liquid absorptances thereof which were measured in advance.

The transfer agent supply device may be as follows.

(1) The transfer agent supply device may include an application roller for holding the transfer agent on its surface, and applying the transfer agent held thereon onto the record medium; and a transfer agent supply unit for supplying the transfer agent onto the surface of the application roller.

(2) The transfer agent supply device may include an application roller for holding the transfer agent on its surface, and applying the transfer agent held thereon onto the record medium; a transfer agent supply roller for supplying the transfer agent onto the surface of the application roller; and a distance changing device for changing a distance between centers of the application roller and the supply roller based on an instruction sent from the control device.

In the transfer agent supply device, the distance of a space between the supply roller and the application roller is controlled, or a pressure between the supply and application rollers is controlled for controlling the quantity of the transfer agent supplied to the application roller, and thereby it is possible to supply the transfer agent of an appropriate quantity depending on the kind of the record medium from the application roller to the record medium so that good transferred images can be produced.

A cam device may be employed as the distance changing device for controlling the distance between the roller centers, although not restricted thereto. This cam device may include a spring for biasing the supply roller toward or away from the application roller, and a cam for driving the liquid supply roller against the force of the spring to control the position of the liquid supply roller with respect to the application roller.

(3) The transfer agent supply device may include an application roller rotating together with the transfer agent held on its surface, and applying the transfer agent held thereon onto the record medium; a transfer agent supply roller spaced from the application roller by a predetermined distance, and rotating to supply the transfer agent onto the surface of the application roller; and a speed changing device for changing the relative surface speed between the application roller and the supply roller based on an instruction sent from the control device.

In this transfer agent supply device, the quantity of the transfer agent transported by the supply roller is controlled, e.g., by changing the peripheral speed of the supply roller, and thereby the quantity of the transfer agent supplied to the application roller is controlled so that the transfer agent of an appropriate quantity depending on the kind of the record medium can be supplied from the application roller onto the record medium for producing good transferred images.

The device for changing the peripheral speed of the supply roller may be, for example, a variable speed motor driving the supply roller, or a drive unit including a motor and a transmission provided with a speed changer and coupled to the supply roller.

(4) The transfer agent supply device may include an application roller rotating together with the transfer agent held on its surface, and applying the transfer agent held thereon to the record medium; a transfer agent supply roller spaced from the application roller by a predetermined distance, and rotating to supply the transfer agent onto the surface of the application roller; a transfer agent restricting member opposed to the surface of the supply roller; and a space changing device for changing a space between the supply roller and the restricting member based on an instruction sent from the control device.

In the transfer agent supply device, the quantity of the transfer agent supplied to the application roller can be controlled by controlling a distance or a pressure between the supply roller and the restricting member. Thereby, the transfer agent of an appropriate quantity depending on the kind of the record medium can be applied from the application roller to the record medium for producing good transferred images.

(5) The transfer agent supply device may include an application roller rotating together with the transfer agent held on its surface, and applying the transfer agent held thereon to the record medium; a transfer agent restricting member opposed to the surface of the application roller; and a space changing device for changing a space between the application roller and the restricting member based on an instruction sent from the control device.

In this transfer agent supply device, the quantity of the transfer agent supplied to the application roller can be controlled by controlling a distance or a pressure between the application roller and the restricting member. Thereby, the transfer agent of an appropriate quantity depending on the kind of the record medium can be applied from the application roller to the record medium for producing good transferred images.

This structure may likewise be provided with a supply roller for supplying the transfer agent to the application roller. The restricting member may be arranged upstream, in the rotating direction of the application roller, to a region for supplying the transfer agent from the application roller to the record medium and downstream, in the above rotating direction, from a region for supplying the transfer agent from the supply roller to the application roller.

In the transfer agent supply device of the above item (4) or (5), the restricting member may have any structure provided that it can restrict the quantity of the transfer agent, and typically may be a blade of a plate. In the supply device of the above item (4) or (5), adjustment of the position of the restricting member may be allowed by such a structure that the restricting member is connected to a stationary member by a screw for position adjustment, or by a cam device which includes a spring for biasing the restricting member toward or away from the roller, and a cam for driving and positioning the restricting member against a force of the spring with respect to the roller.

Any one of the transfer agent supply devices of the above items (1)–(5) may use transfer liquid as the transfer agent, in which case the transfer liquid can be applied to the transfer agent supply roller, for example, by such a structure that the supply roller is disposed in a transfer liquid tank and is partially located in the transfer liquid for scooping up the transfer liquid, or that the transfer liquid is supplied, by its own weight or a pump, to the supply roller through a nozzle connected to the transfer liquid tank. The former structure in which the supply roller is partially in contact with the transfer liquid in the transfer liquid tank can be simple.

Any one of the transfer agent supply devices provided with the application rollers may be provided with a backup member opposed to the application roller with the record medium therebetween. The backup member may be a backup roller, a transporting belt, a stationary member such as a guide plate or the like. Among them, the backup roller is desirable in view of transportation of the record medium and simplicity of the structure. In any case, the application roller and the backup member may be made of metal, rubber, synthetic resin, combination of them or the like. If the transfer liquid is used, and the bodies of the application roller and the backup member are made of a liquid absorbent material, it is desired that the application roller and the backup member are provided at least at their surfaces with liquid unabsorbent layers made of, e.g., synthetic resin such as tetrafluoroethylene or polyamide, which does not absorb the liquid.

The transfer agent supply devices of any one of the foregoing types may be arranged at a plurality of positions between the position for supplying the record medium and the position for transfer, respectively.

In this case, the image forming apparatus may be provided with a control device, which controls the quantity of the transfer agent supplied to the record medium in accordance with the property of the record medium already determined with respect to the record medium. This control device can control the plurality of transfer agent supply devices to supply the transfer agent from the transfer agent supply device(s) already determined in accordance with the property of the record medium.

In this case, each of the transfer agent supply devices is capable of supplying a constant quantity of the transfer agent, and the transfer agent may be supplied from one or more of the transfer agent supply device(s) in accordance with the property of the record medium. In this case, the constant quantity of the transfer agent to be supplied from each of the respective transfer agent supply devices may be equal to those of all the other devices, may be different only from that or those of one or some of the other devices, or may be different from those of all the other devices.

As already described, the invention may be applied to the color image forming apparatus of the tandem type which can perform fast image formation.

According to another embodiment of the invention, therefore, an image forming apparatus includes, similarly to the foregoing image forming apparatus:

an image holding device for holding on its surface an image developed with liquid developer;

a record medium transporting device for transporting a record medium from a supply position to a transfer position for transferring the image developed on the image holding device onto a surface of the record medium; and a transfer agent supply device for supplying a transfer agent onto the above surface of the record medium during transportation between the supply position of the record medium and the transfer position. In this embodiment, however, the image holding devices are plural in number, and the above transfer position is provided correspondingly to each of the image holding devices. The record medium transporting device is operable to pass the record medium successively through the transfer positions corresponding to the plurality of image holding devices, respectively. The transfer agent supply device is arranged upstream, in the record medium transporting direction, to the most upstream transfer position.

In the above wet image forming apparatus, the transfer agent supply device supplies the transfer agent of the quantity corresponding to the kind of the record medium prior to first transfer of the developed image formed on the image holding device to the record medium. In any of the first and subsequent transfer positions, the record medium does not absorb or hardly absorbs carrier liquid coexisting with the developed image. Accordingly, good transfer images can be formed on the record medium independently of the kind of the record medium even if the carrier liquid is constant in quantity at all the first and subsequent transfer positions, and even if consideration is not given to the order of transfer of the toner images of the respective colors.

In any of the wet image forming apparatus, transfer liquid may be used as the transfer agent, and the visible toner image may be fixed to the record medium by a heat, in which case, for example, the transfer liquid evaporated from the record medium by the fixing heat may be collected and refined for reuse as the transfer liquid.

Preferred embodiments of the invention will be described below with reference to the drawings.

Figure 2:
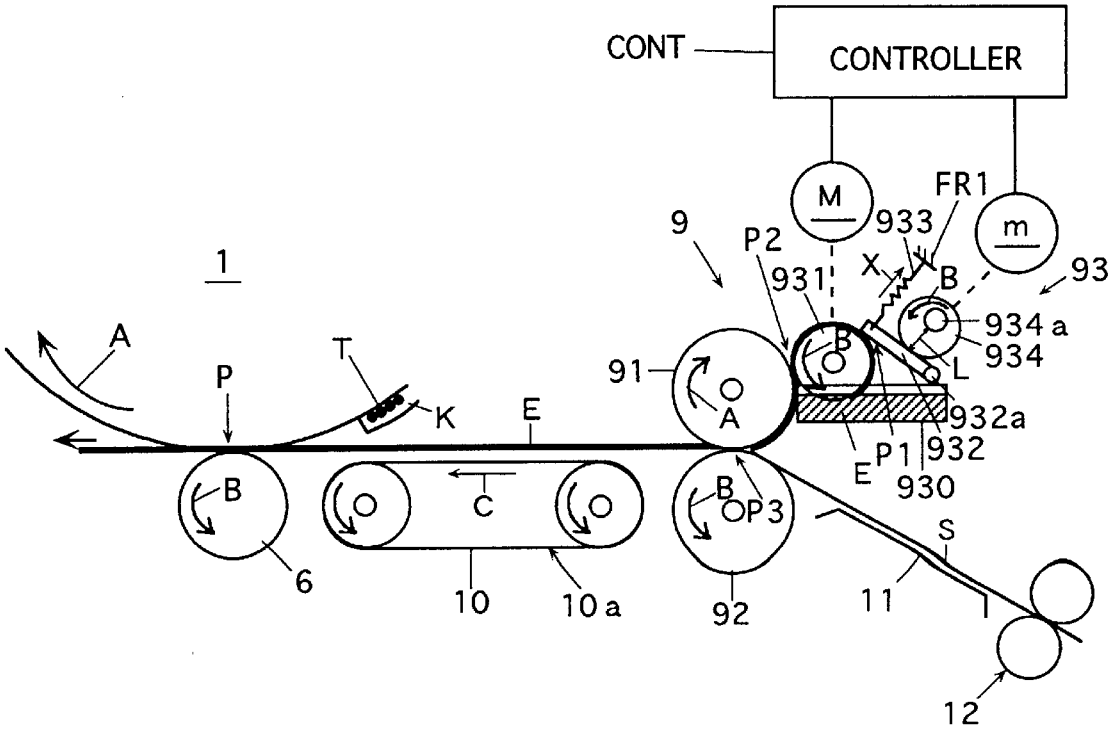
FIG. 2 is a fragmentary side view of the image forming apparatus shown in FIG. 1.

FIG. 1 shows by way of example a schematic structure of an electrophotographic wet image forming apparatus according to the invention. FIG. 2 is a fragmentary side view of the wet image forming apparatus shown in FIG. 1.

An wet image forming apparatus shown in FIG. 1 is provided at its center with a drum-like photosensitive member 1 (an example of an electrostatic latent image carrier). Around the photosensitive member 1, there are arranged a main charger 2, an exposure optical system 3, a liquid developing device 4, a squeeze roller 5, a transfer roller 6, a cleaning blade 7 and a discharging lamp 8 in this order.

The photosensitive member 1 is driven to rotate in a clockwise direction A in FIG. 1. Although the photosensitive member 1 has a drum-like form, it may be made of a photosensitive belt having a belt-like form.

The transfer roller 6 is opposed to the photosensitive member 1, and forms a transfer portion P in the figure. At the right of the transfer portion P in the figure, there are arranged a transporting device 10, a transfer liquid application device 9, a guide plate 11 and a timing roller pair 12 as well as a paper sheet supply unit (not shown). At the left in the figure, there are successively arranged a guide plate 13 and a fixing device 14 as well as a discharge roller pair and a discharged sheet tray (both not shown in the figure).

Main charger 2 can be supplied with a high voltage from a power source PW1, and thereby can charge the photosensitive member 1.

Based on image information sent from, e.g., an image reader (not shown), the exposure optical system 3 can irradiate the photosensitive member 1 with laser light LL to form an electrostatic latent image on the photosensitive member 1.

The liquid developing device 4 includes a developing roller 41 and a developer tank 42 accommodating liquid developer D which contains toner and carrier liquid. The developing roller 41 is driven to rotate in a counterclockwise direction B in FIG. 1, and can be supplied with a developing bias voltage from a power source PW2. Thereby, the electrostatic latent image on the photosensitive member 1 can be developed.

The squeeze roller 5 is opposed to the photosensitive member 1, and is driven to rotate. The squeeze roller 5 can remove and reduce surplus carrier liquid, which is adhered to the photosensitive member 1, to a predetermined constant quantity. Although the squeeze roller 5 shown in FIG. 1 is independent of the liquid developing device 4, it may be arranged at the substantially same position as the liquid developing device 4 and may be integrated with the device 4.

The transfer roller 6 is driven to rotate in the direction B in FIG. 1, and can be supplied with a transfer voltage (i.e., a voltage for transfer) from a power source PW3 so that the toner image on the photosensitive member 1 can be transferred onto a record sheet S of paper, which will be described later. Although the transfer roller 6 is employed in this embodiment, it may be replaced with another structure such as a transfer charger, in which a transfer voltage is applied to a charge wire for transferring the toner image onto the record sheet S. Instead of the structures such as a transfer roller or a transfer charger performing electrostatic transfer, another structure such as a thermal transfer roller, which thermally performs the transfer under an appropriate pressure, may be employed.

The cleaning blade 7 is in direct contact with the photosensitive member 1, and can remove residual toner which was not transferred onto the record sheet S and remained on the photosensitive member 1.

The discharging lamp 8 can irradiate the photosensitive member 1 with light to remove electric charges on the photosensitive member 1.

The transfer liquid application device (transfer liquid supply device) 9 includes an application roller 91, a backup roller 92 and a liquid supply device 93 as shown in FIG. 2. The application roller 91 is driven to rotate in the direction A in the figure, and can apply transfer liquid E, which is supplied from the liquid supply device 93, to the record sheet S. The backup roller 92 is driven to rotate in the direction B in the figure. The backup roller 92 is opposed to the application roller 91 with the record sheet S therebetween, and is rotated by the roller 91 to send the record sheet S to the transporting device 10. The application roller 91 and the backup roller 92 are provided at their surfaces with liquid unabsorbent layers, respectively.

The liquid supply device 93 includes a transfer liquid tank 930, a liquid supply roller 931, an electric motor M, a blade 932 (an example of a transfer liquid restricting member), a spring 933, an eccentric cam 934 and an electric motor m. The transfer liquid tank 930 contains the transfer liquid E. The liquid supply roller 931 is in contact with the application roller 91, and is connected to the motor M. The roller 931 is partially located in the transfer liquid E, and is driven to rotate in the direction B by the motor M for scooping up the transfer liquid E. Thereby, the liquid supply roller 931 can supply the transfer liquid E to the application roller 91. In this embodiment, the transfer liquid E is the same as carrier liquid contained in the liquid developer D in the liquid developing device 4.

The blade 932 is pivotably carried at one of its ends around a support shaft 932*a*, and the other end thereof can move toward and away from the liquid supply roller 931. One of the ends of the spring 933 is connected to the blade 932, and the other end is connected to a stationary member FR1. The spring 933 always pulls the blade 932 in a direction X, i.e., away from the roller 931. The eccentric cam 934 is in contact with the blade 932. The cam 934 is connected to the motor m via a shaft 934*a*, and is driven to rotate in the direction B. The motor m is connected to a controller CONT, which will be described later. By controlling a rotational position of the motor m, the angular position of the eccentric cam 934 is changed to restrict the quantity of the transfer liquid E, which is supplied from the supply roller 931 to the application roller 91, to a predetermined value.

More specifically, when the cam 934 is in the position maximizing a distance L from the shaft 934*a* of the cam 934 to its portion in contact with the blade 932, the blade 932 is located near the liquid supply roller 931 with a minimum distance therebetween. When the roller 931 is in contact with the blade 932, the degree of contact between the blade 932 and the roller 931 is maximized. As the distance L decreases, the blade 932 is moved away from the liquid supply roller 931 and thereby increases the distance between them. When the roller 931 is still in contact with the blade 932, the degree of contact between the roller 931 and the blade 932 decreases.

By controlling the angular position of the eccentric cam 934, the distance or the degree of contact between the blade 932 and the liquid supply roller 931 can be controlled so that the quantity of the transfer liquid E supplied to the application roller 91 can be restricted, and therefore the quantity of the transfer liquid E applied to the record sheet S can be controlled.

The transporting device 10 includes a transporting belt 10*a*, which is retained around two transporting rollers, and is driven in a direction C in the figure.

Figure 3A:
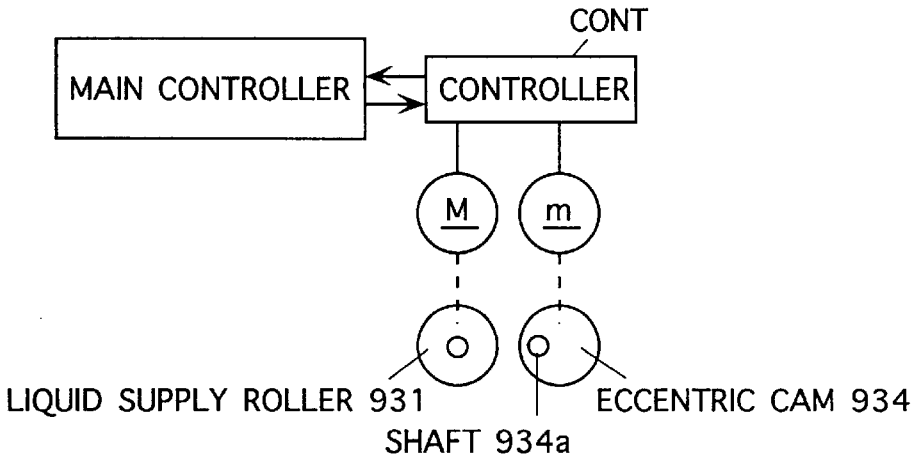
FIGS. 3(A), 3(B) and 3(C) are block diagrams showing by way of example control circuits of transfer liquid applying devices, respectively.

The controller CONT includes a computer as a main component. As shown in FIGS. 1 and 2, the controller CONT can control the start and stop of the motor M and can also control the rotational position of the motor m based on an instruction signal sent from an main controller (see FIG. 3(A)) controlling the whole operation of the image forming apparatus. Although the controller CONT is arranged independently of the main controller, it may be incorporated in the main controller.

In this wet image forming apparatus, the photosensitive member 1 is rotated and thereby is uniformly charged by the main charger 2.

The charged region is exposed with the laser light LL emitted from the exposure optical system 3 so that an electrostatic latent image is formed thereon. The electrostatic latent image moves to the liquid developing device 4 in accordance with rotation of the photosensitive member 1.

In the liquid developing device 4, the developing roller 41 is partially located in the liquid developer D, and scoops up the developer D when rotating. The scooped developer D is supplied to the electrostatic latent image formed on the photosensitive member 1 so that the electrostatic latent image is developed into the visible toner image T with the developing bias voltage applied thereto.

The visible toner image T on the photosensitive member 1 moves to the transfer portion P together with a constant quantity of carrier liquid K, from which surplus carrier liquid is removed by the squeeze roller 5.

The toner image moved to the transfer portion P is transferred onto the record sheet S. The transfer sheet S is fed to the timing roller pair 12 from the sheet supply tray (not shown) by the feed roller (not shown). The timing roller pair 12 feeds the record sheet S in synchronization with the toner image on the photosensitive member 1. The record sheet S guided by the guide plate 11 moves to the transfer liquid application device 9.

In the transfer liquid application device 9, the motor M receives the instruction signal from the controller CONT, and drives the liquid supply roller 931. The transfer liquid E scooped by the rotating liquid supply roller 931 moves to an opposition region P1 where the roller 931 and the blade 932 are opposed to each other. In the region P1, the transfer liquid E is restricted to a constant quantity by controlling the position of the blade 932 with respect to the liquid supply roller 931. The position of the blade 932 with respect to the liquid supply roller 931 is controlled by controlling the angular position of the eccentric cam 934 in accordance with the instruction signal sent from the controller CONT (see FIG. 3(A)). This control is performed such that the transfer liquid E of a constant quantity, which is determined, in advance, depending on the kind of the record sheet S, can be applied to the record sheet S. More specifically, if the quantity of the transfer liquid E to be applied to the record sheet S is large, the control is performed to reduce the distance L from the shaft 934*a* of the eccentric cam 934 to its portion in contact with the blade 932, and thereby move the blade 932 away from the liquid supply roller 931 for locating the blade 932 remote from the liquid supply roller 931. If the required quantity of the transfer liquid E is small, the control is performed to increase the distance L from the shaft 934*a* of the eccentric cam 934 to its portion in contact with the blade 932, and thereby move the blade 932 toward the liquid supply roller 931 to locate the blade 932 near the liquid supply roller 931.

The transfer liquid E passed through the region P1 moves to an opposition region P2, where the roller 931 and the application roller 91 are opposed to each other, in accordance with rotation of the liquid supply roller 931. In the region P2, the transfer liquid E on the liquid supply roller 931 is partially supplied to the application roller 91. The transfer liquid E supplied to the roller 91 moves to an opposition region P3, where the roller 91 and the backup roller 92 are opposed to each other, in accordance with rotation of the roller 91. In the region P3, the transfer liquid E on the application roller 91 is partially applied to the record sheet S. Thereby, the transfer liquid E of the constant quantity depending on the kind of the record sheet S is applied to the record sheet S. Since the record sheet S absorbs the transfer liquid E thus applied, absorption of liquid into the record sheet S will be suppressed thereafter.

Even if the quantity of the transfer liquid E applied to the record sheet S is larger than the required quantity to some extent, the nip between the application roller 91 and the backup roller 92 prevents passing of the surplus transfer liquid E when the record sheet S passes therethrough.

The application roller 91 may be controlled to start rotation substantially in synchronization with entry of the record sheet S so that the transfer liquid E may be applied only to the record sheet S.

After absorbing the transfer liquid, the record sheet S is transported to the transfer portion P by the transporting device 10.

In the transfer portion P, the transfer roller 6 pushes the rear surface of the record sheet S toward the photosensitive member 1. The toner image on the photosensitive member 1 comes into contact with the record sheet S, and is transferred onto the record sheet S by the voltage, which is supplied from the power source PW3 and attracts the toner image toward the roller 6.

Since the transfer liquid E was applied to the record sheet S prior to transfer of the toner image onto the record sheet S, the record sheet S contains the transfer liquid E absorbed thereinto, and thereafter is effectively prevented from further absorbing the liquid. More specifically, in the process of transferring the visible toner image on the photosensitive member 1 onto the record sheet S which has already absorbed the transfer liquid E, the record sheet S does not absorb or hardly absorbs the carrier liquid K adhered onto the photosensitive member 1. Depending on the kind (liquid absorptance, surface roughness or the like) of the record sheet S, the quantity of the transfer liquid E applied to the record sheet S is changed so that the transfer liquid of the quantity required for good transference may be applied. Therefore, good transferred images can be formed independently of the kinds of the record sheets S even if the carrier liquid K adhered to the photosensitive member 1 is constant independently of the kinds of the record sheets S.

The record sheet S bearing the transferred toner image is transported along the guide plate 13 to the fixing device 14, which fixes the toner image to the record sheet S. Thereafter, the record sheet S is discharged to the discharged sheet tray by the discharging roller pair (not shown).

The photosensitive member 1 holds the residual toner which was not transferred onto the record sheet S, and the cleaning blade 7 removes this residual toner. Thereafter, the discharging lamp 8 irradiates the photosensitive member 1 with light to remove residual charges on the photosensitive member 1. Thereby, the photosensitive member 1 is ready for the next image formation.

Other examples of the transfer liquid application device will now be described below. Each of the transfer liquid application devices, which will be described below with reference to FIGS. 4 to 6, respectively, may be mounted in the wet image forming apparatus shown in FIG. 1 instead of the transfer liquid application device 9. Therefore, the structures and operations of the wet image forming apparatuses will not be discussed, and structures and operations of the transfer liquid application devices will be primarily discussed.

Figure 4:
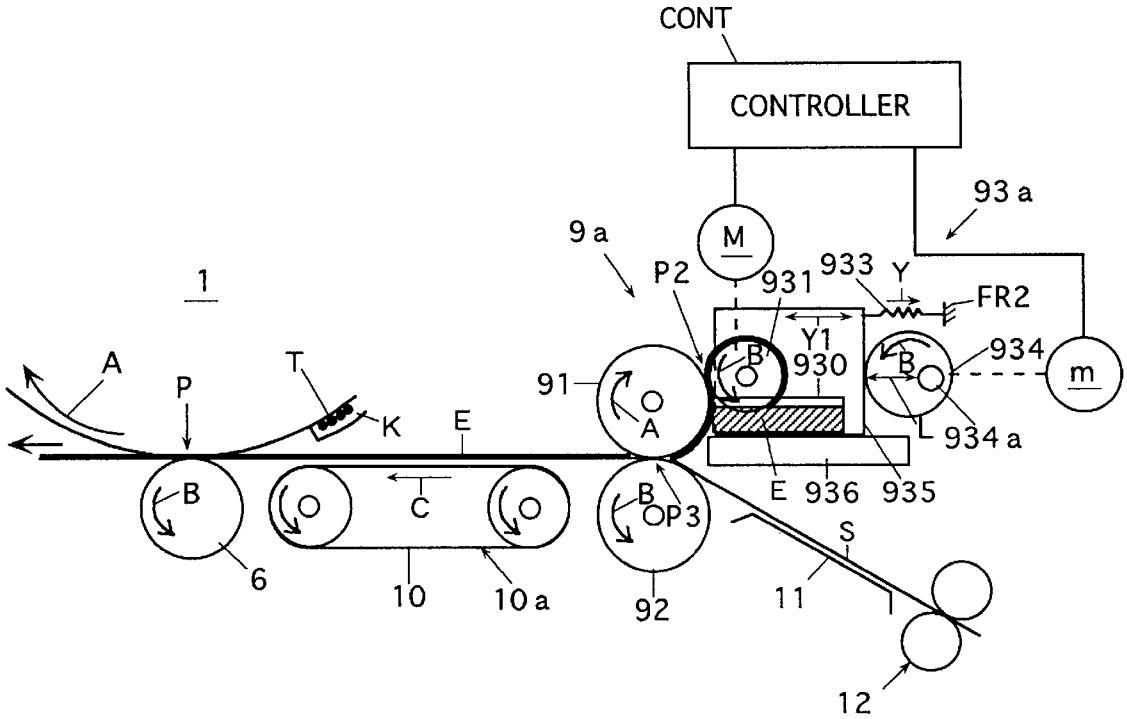
FIG. 4 is a fragmentary side view of a wet image forming apparatus employing another transfer liquid applying device in place of the transfer liquid applying device in the image forming apparatus shown in FIG. 1.

FIG. 4 is a fragmentary side view of the wet image forming apparatus equipped with another example of the transfer liquid application device.

A transfer liquid application device 9*a* shown in FIG. 4 controls the quantity of the transfer liquid by controlling a distance between the centers of the liquid supply roller 931 and the application roller 91 in contrast to the transfer liquid application device 9 shown in FIGS. 1 and 2 which controls the quantity of the transfer liquid by controlling the relative position of the blade 932 to the liquid supply roller 931. Structures other than the above are the same as those of the wet image forming apparatus shown in FIG. 1, and the same parts and portions bear the same reference numbers.

As shown in FIG. 4, the transfer liquid application device 9*a* includes the application roller 91, the backup roller 92 and a liquid supply device 93*a*. The application roller 91 is driven to rotate in the direction A in the figure, and can apply the transfer liquid E, which is supplied from the liquid supply device 93*a*, to the record sheet S. The backup roller 92 is driven to rotate in the direction B in the figure. The backup roller 92 is opposed to the application roller 91 with the record sheet S therebetween, and can cooperate with the rotating roller 91 to send the record sheet S to the transporting device 10.

The liquid supply device 93*a* includes the transfer liquid tank 930, the liquid supply roller 931, the motor M, the spring 933, the eccentric cam 934, a device frame 935, a support member 936 and the motor m. The device frame 935 carries the transfer liquid tank 930 and the liquid supply roller 931. The transfer liquid tank 930 accommodates the transfer liquid E. The liquid supply roller 931 is opposed to the application roller 91, and is connected to the motor M. The roller 931 is partially located in the transfer liquid E, and is driven to rotate in the direction B by the motor M for scooping up the transfer liquid E. Thereby, the liquid supply roller 931 can supply the transfer liquid E to the application roller 91.

The device frame 935 is supported by the support member 936, and can reciprocate in a direction Y1 in the figure. An end of the spring 933 is connected to the device frame 935, and the other end thereof is connected to the stationary member FR2. The spring 933 always pulls the device frame 935 away from the application roller 91, i.e., in a direction Y. The eccentric cam 934 is in contact with the device frame 935. The cam 934 has the shaft 934*a* connected to the motor m, and is driven to rotate in the direction B by the motor m. The motor m is connected to the controller CONT. By controlling the rotational position of the motor m, an angular position of the eccentric cam 934 can be changed to restrict the quantity of the transfer liquid E supplied to the application roller 91.

When the cam 934 is in the position maximizing the distance L from the shaft 934*a* to its portion in contact with the device frame 935, the device frame 935 is located near the application roller 91 so that the minimum distance is spaced between the liquid supply roller 931 and the application roller 91. When the roller 91 is in contact with the roller 931, the degree of contact between the roller 91 and the roller 931 is maximized. As the distance L decreases, the device frame 935 is moved away from the application roller 91 and thereby increases the distance between the application roller 91 and the liquid supply roller 931. When the roller 931 is still in contact with the roller 91, the degree of contact between the roller 931 and roller 91 decreases.

By controlling the angular position of the eccentric cam 934, the distance or the degree of contact between the application roller 91 and the liquid supply roller 931 can be controlled so that the quantity of the transfer liquid E supplied to the application roller 91 can be restricted, and therefore the transfer liquid E, of which quantity depends on the kind of the record sheet S, can be applied to the record sheet S.

In the transfer liquid application device 9*a*, the controller CONT sends the instruction signal to the motor M to drive and rotate the liquid supply roller 931. In accordance with rotation of the liquid supply roller 931, the scooped transfer liquid E moves to the opposition region P2 between the roller 931 and the application roller 91. In the region P2, the quantity of the transfer liquid E is restricted depending on the distance between the centers of the application roller 91 and the liquid supply roller 931. The distance between the centers of the liquid supply roller 931 and the application roller 91 is controlled in accordance with the angular position of the eccentric cam 934 which is determined by the instruction signal sent from the controller CONT (see FIG. 3(A)). This control is performed such that the transfer liquid E of the predetermined quantity corresponding to the value, which is determined in advance depending on the kind of the record sheet S, can be applied to the record sheet S. More specifically, if the quantity of the transfer liquid E to be applied to the record sheet S is large, the distance L from the shaft 934*a* of the eccentric cam 934 to its portion in contact with the device frame 935 is reduced to move the device frame 935 away from the application roller 91 so that the distance between the centers of the application roller 91 and the liquid supply roller 931 is increased. If the required quantity of the transfer liquid E is small, the distance L from the shaft 934*a* of the eccentric cam 934 to its portion in contact with the device frame 935 is increased to move the device frame 935 toward the application roller 91 so that the distance between the centers of the application roller 91 and the liquid supply roller 931 is reduced.

In this embodiment, the spring 933 is provided for the device frame 935 for sliding the same in the direction Y1. Alternatively, the spring 933 may be connected to the bearing of the liquid supply roller 931, and the cam 934 may be acted on this bearing.

Figure 5:
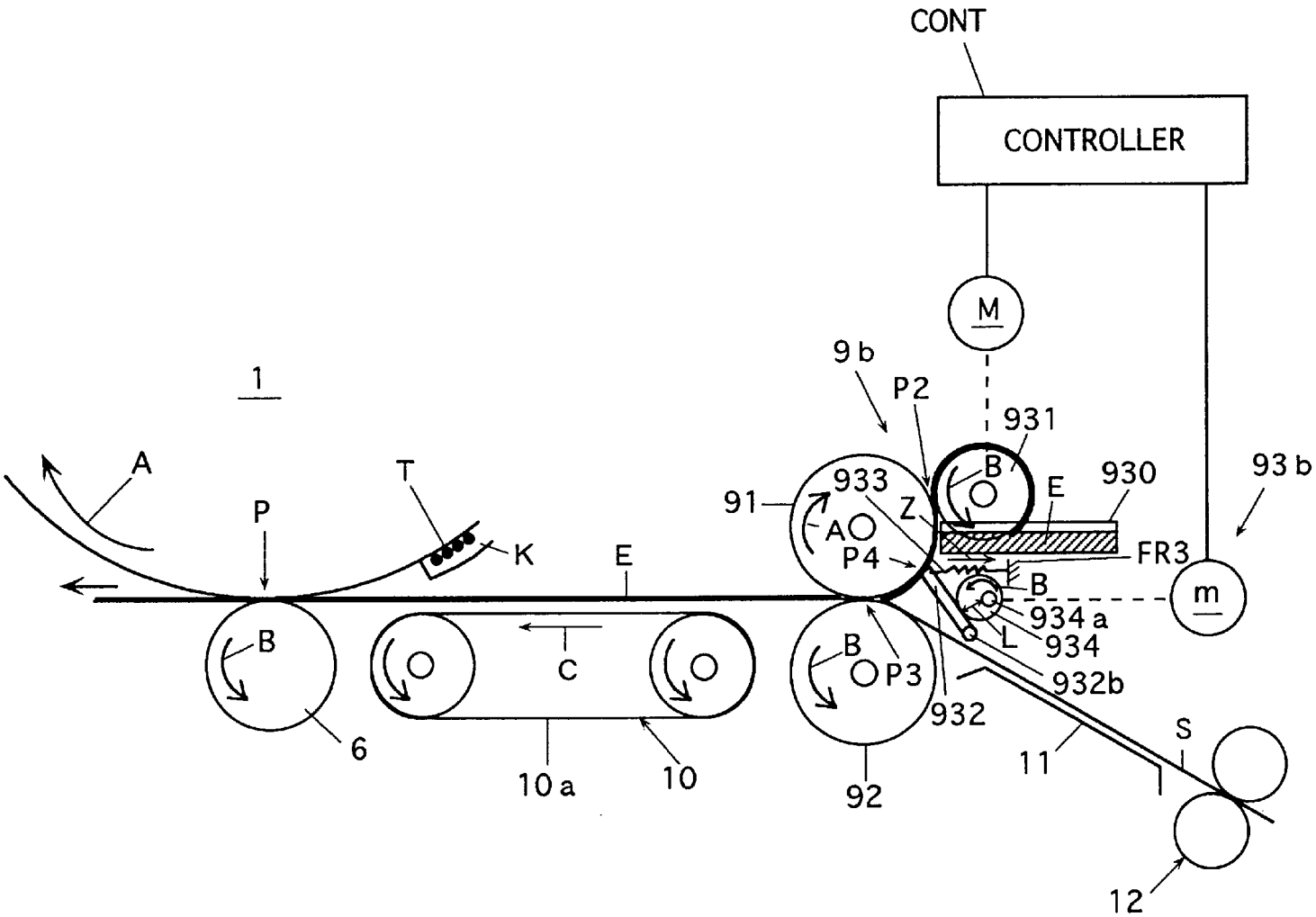
FIG. 5 is a fragmentary side view of a wet image forming apparatus employing still another transfer liquid applying device in place of the transfer liquid applying device in the image forming apparatus shown in FIG. 1.

FIG. 5 is a fragmentary side view of the wet image forming apparatus equipped with still another example of the transfer liquid application device instead of the transfer liquid application device 9 in the image forming apparatus shown in FIG. 1.

A transfer liquid application device 9*b* shown in FIG. 5 controls the quantity of the transfer liquid by controlling a position of the blade 932 with respect to the application roller 91 in contrast to the transfer liquid application device 9 shown in FIGS. 1 and 2 which controls the quantity of the transfer liquid by controlling the relative position of the blade 932 to the liquid supply roller 931. Structures other than the above are the same as those of the wet image forming apparatus shown in FIG. 1, and the same parts and portions bear the same reference numbers.

As shown in FIG. 5, the transfer liquid application device 9*b* includes the application roller 91, the backup roller 92 and a liquid supply device 93*b*. The application roller 91 is driven to rotate in the direction A in the figure, and can apply the transfer liquid E, which is supplied from the liquid supply device 93*b*, to the record sheet S. The backup roller 92 is driven to rotate in the direction B in the figure. The backup roller 92 is opposed to the application roller 91 with the record sheet S therebetween, and can cooperate with the rotating roller 91 to send the record sheet S to the transporting device 10.

The liquid supply device 93*b* includes the transfer liquid tank 930, the liquid supply roller 931, the motor M, the blade 932 (an example of the transfer liquid restricting member), the spring 933, the eccentric cam 934 and the motor m. The transfer liquid tank 930 accommodates the transfer liquid E. The liquid supply roller 931 is in contact with the application roller 91, and is connected to the motor M. The roller 931 is partially located in the transfer liquid E, and is driven to rotate in the direction B by the motor M for scooping up the transfer liquid E. Thereby, the liquid supply roller 931 can supply the transfer liquid E to the application roller 91.

The blade 932 is pivotably carried at one of its ends around a support shaft 932*b*, and the other end thereof can move toward and away from the application roller 91. An end of the spring 933 is connected to the blade 932, and the other end thereof is connected to a stationary member FR3. The spring 933 always pulls the blade 932 in a direction Z. The eccentric cam 934 is in contact with the blade 932. The cam 934 has the shaft 934*a* connected to the motor m, and is driven to rotate in the direction B by the motor m. The motor m is connected to the controller CONT. By controlling the rotational position of the motor m, an angular position of the eccentric cam 934 can be changed to restrict the quantity of the transfer liquid E adhering to the application roller 91.

When the cam 934 is in the position maximizing the distance L from the shaft 934*a* to its portion in contact with the blade 932, the blade 932 is located near the application roller 91 so that the minimum distance is spaced between the blade 932 and the application roller 91. When the roller 91 is in contact with the blade 932, the degree of contact between the roller 91 and the blade 932 is maximized. As the distance L decreases, the blade 932 is moved away from the application roller 91 and thereby increases the distance between the application roller 91 and the blade 932. When the blade 932 is still in contact with the roller 91, the degree of contact between the blade 932 and roller 91 decreases.

By controlling the angular position of the eccentric cam 934, the distance or the degree of contact between the application roller 91 and the blade 932 can be controlled so that the quantity of the transfer liquid E adhering to the application roller 91 can be restricted, and therefore the predetermined quantity of transfer liquid E can be applied to the record sheet S.

In the transfer liquid application device 9*b*, the controller CONT sends the instruction signal to the motor M to drive and rotate the liquid supply roller 931. In accordance with rotation of the liquid supply roller 931, the scooped transfer liquid E moves to the opposition region P2 between the roller 931 and the application roller 91. In the region P2, the transfer liquid E is partially supplied to the application roller 91. Then, the transfer liquid E moves to an opposition region P4 where the application roller 91 and the blade 932 are opposed to each other.

In the region P4, the quantity of the transfer liquid E is restricted depending on the relative position of blade 932 with respect to the application roller 91. The relative position of the blade 932 with respect to the application roller 91 is controlled in accordance with the angular position of the eccentric cam 934 which is determined by the instruction signal sent from the controller CONT (see FIG. 3(A)). This control is performed such that the transfer liquid E of the predetermined quantity corresponding to the value, which is determined in advance depending on the kind of the record sheet S, can be applied to the record sheet S. More specifically, if the quantity of the transfer liquid E to be applied to the record sheet S is large, the distance L from the shaft 934*a* of the eccentric cam 934 to its portion in contact with the blade 932 is reduced to move the blade 932 away from the application roller 91 so that the blade 932 may be located remote from the application roller 91. If the required quantity of the transfer liquid E is small, the distance L from the shaft 934*a* of the eccentric cam 934 to its portion in contact with the blade 932 is increased to move the blade 932 toward the application roller 91 so that the blade 932 may be located near the application roller 91.

Figure 6:
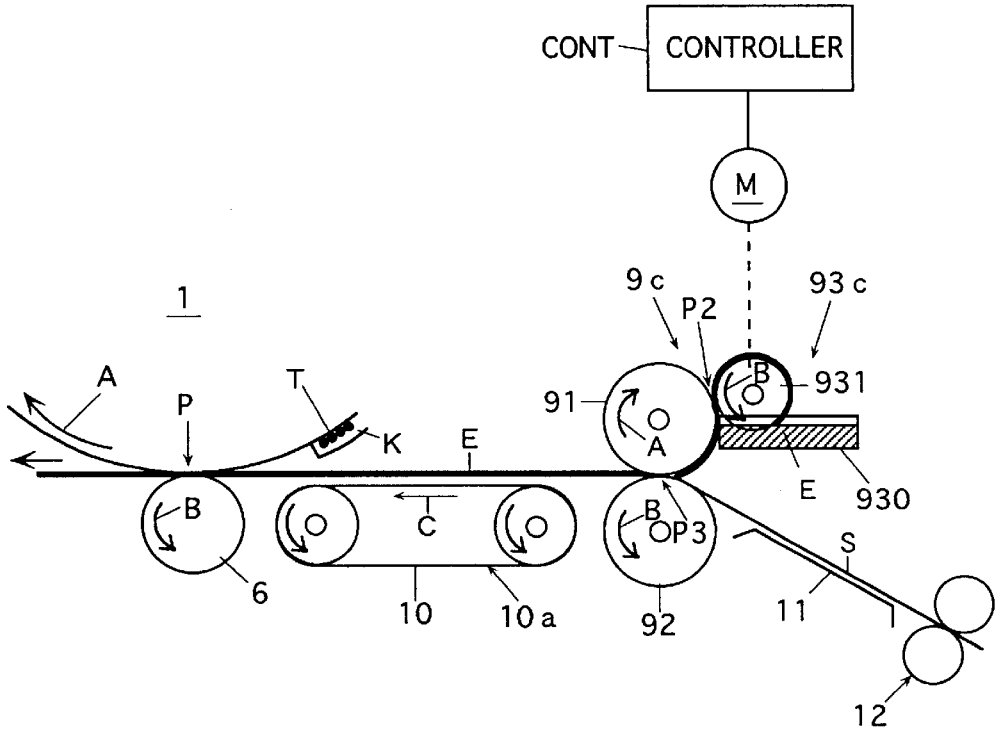
FIG. 6 is a fragmentary side view of a wet image forming apparatus employing yet another transfer liquid applying device in place of the transfer liquid applying device in the image forming apparatus shown in FIG. 1.

FIG. 6 is a fragmentary side view of the wet image forming apparatus equipped with yet another example of the transfer liquid application device instead of the transfer liquid application device 9 in the image forming apparatus shown in FIG. 1.

A transfer liquid application device 9*c* shown in FIG. 6 controls the quantity of the transfer liquid by controlling a peripheral speed of the liquid supply roller 931 in contrast to the transfer liquid application device 9*a* shown in FIG. 4 which controls the quantity of the transfer liquid by controlling the distance between the centers of the liquid supply roller 931 and the application roller 91. Structures other than the above are the same as those of the wet image forming apparatus shown in FIG. 1, and the same parts and portions bear the same reference numbers.

In this example, the controller CONT can control the rotation speed of the motor M and thus the peripheral speed of the liquid supply roller 931.

As shown in FIG. 6, the transfer liquid application device 9*c* includes the application roller 91, the backup roller 92 and a liquid supply device 93*c*. The application roller 91 is driven to rotate in the direction A in the figure, and can apply the transfer liquid E, which is supplied from the liquid supply device 93*c*, to the record sheet S. The backup roller 92 is driven to rotate in the direction B in the figure. The backup roller 92 is opposed to the application roller 91 with the record sheet S therebetween, and can cooperate with the rotating roller 91 to send the record sheet S to the transporting device 10.

The liquid supply device 93*c* includes the transfer liquid tank 930, the liquid supply roller 931 and the motor M. The transfer liquid tank 930 accommodates the transfer liquid E. The liquid supply roller 931 is spaced from the application roller 91 by a constant distance, and is connected to the motor M. The roller 931 is partially located within the transfer liquid E, and is driven to rotate in the direction B by the motor M for scooping up the transfer liquid E. Thereby, the liquid supply roller 931 can supply the transfer liquid E to the application roller 91. By controlling the peripheral speed of the roller 931, the quantity of the scooped transfer liquid E is controlled.

Figure 3B:
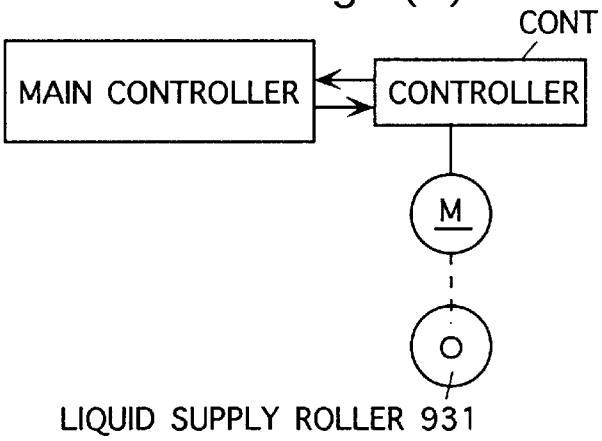

In the transfer liquid application device 9*c*, the controller CONT sends the instruction signal to the motor M to drive and rotate the liquid supply roller 931. In accordance with rotation of the liquid supply roller 931, the scooped transfer liquid E moves to the opposition region P2 between the roller 931 and the application roller 91. In the region P2, the transfer liquid E, of which quantity depends on the peripheral speed of the liquid supply roller 931, is supplied to the application roller 91. The peripheral speed of the roller 931 is controlled by the instruction signal sent from the controller CONT (see FIG. 3(B)). This control is performed such that the transfer liquid E of the predetermined quantity corresponding to the value, which is determined in advance depending on the kind of the record sheet S, can be applied to the record sheet S. More specifically, if the quantity of the transfer liquid E to be applied to the record sheet S is large, the peripheral speed of the liquid supply roller 931 is increased. If the required quantity of the transfer liquid E is small, the peripheral speed of the liquid supply roller 931 is reduced.

Figure 7:
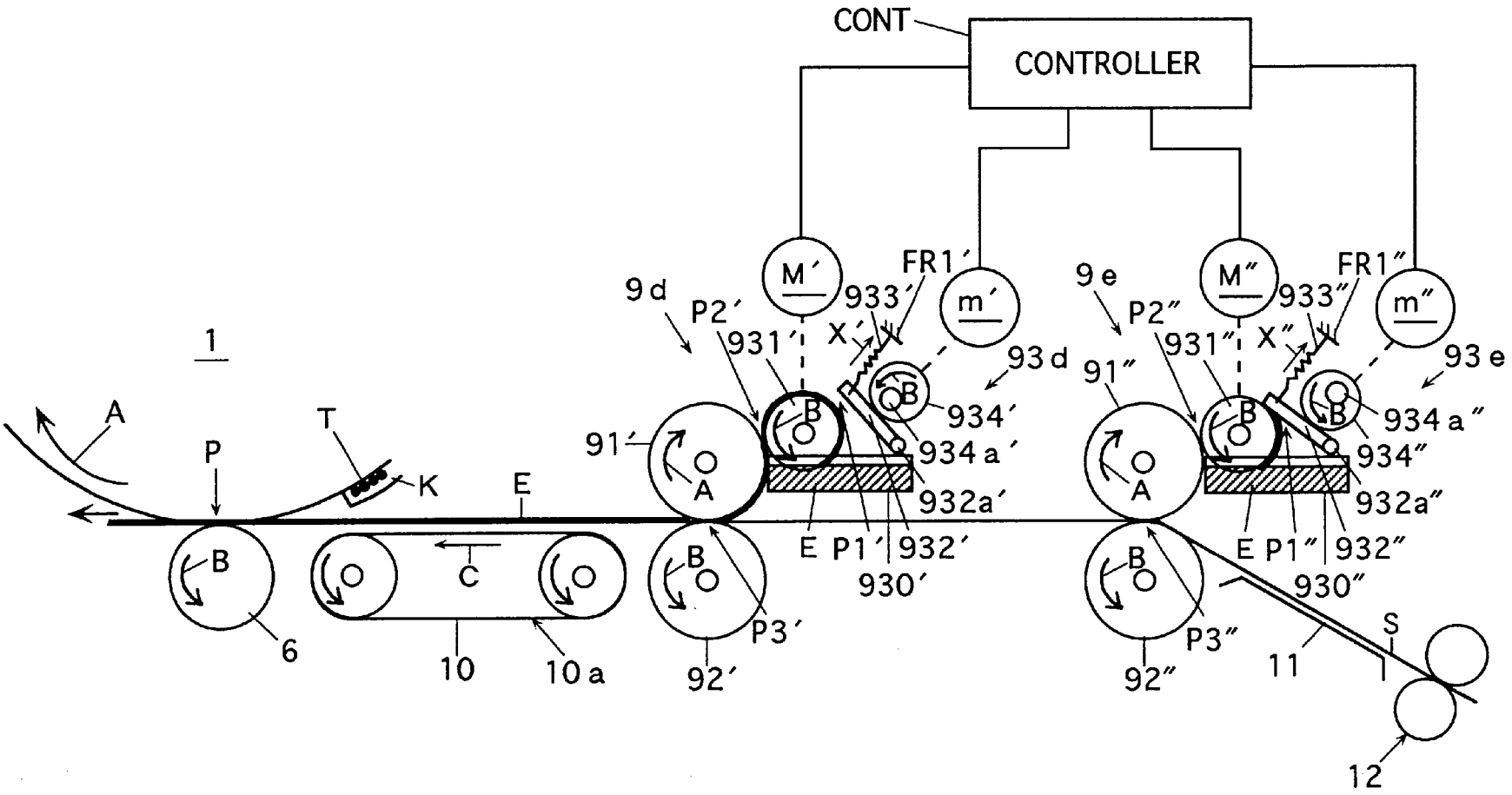
FIG. 7 is a fragmentary side view of a modification of the image forming apparatus shown in FIG. 1.

FIG. 7 is a fragmentary side view of a modification of the image forming apparatus shown in FIG. 1.

The wet image forming apparatus shown in FIG. 7 is provided with transfer liquid application devices 9*d* and 9*e* having the substantially same structures as the transfer liquid application device 9 shown in FIG. 1. These transfer liquid application devices are arranged successively along the transportation path of the record sheet S. The quantities of the transfer liquid E, which can be applied by transfer liquid application devices 9*d* and 9*e* to the record sheet S, are constant and are determined in accordance with the quantities of the transfer liquid E scooped by the liquid supply rollers 931' and 931", respectively. Depending on the kind of the record sheet S, one or both of the transfer liquid application devices 9*d* and 9*e* apply the transfer liquid E to the record sheet S. Structures other than the above are the same as those of the wet image forming apparatus shown in FIG. 1, and the same parts and portions bear the same reference numbers.

In this modification, the controller CONT controls the start and stop of motors M' and M" as well as rotational positions of the motors m' and m".

In the transfer liquid application devices 9*d* and 9*e*, the application rollers 91' and 91" are driven to rotate when the record sheet S are sent between the application rollers 91' and 91" and backup rollers 92' and 92", respectively. During this, liquid supply rollers 931' and 931" are also driven to rotate. However, the blades 932' and 932" are operated only when the corresponding transfer liquid application devices are to be actually operated, respectively. More specifically, the blade 932' or 932" to be operated is moved away from the liquid supply roller 931' or 931" in accordance with the controlled angular position of an eccentric cam 934' or 934" driven by a motor m' or m" so that the liquid supply roller scoops up the transfer liquid and supplies the constant quantity of the transfer liquid to the application roller. In this manner, the transfer liquid of the quantity, which depends on the kind of the record sheet, is applied to the record sheet S by the application roller.

In the transfer liquid application device which is not actually used, the motor m" (or m') controls the angular position of the eccentric cam 934" (934') to press the blade 932" (932') strongly against the liquid supply roller 931" (931') so that the transfer liquid scooped by the liquid supply roller is scraped off, and is not substantially supplied to the application roller 91" (91').

Figure 3C:
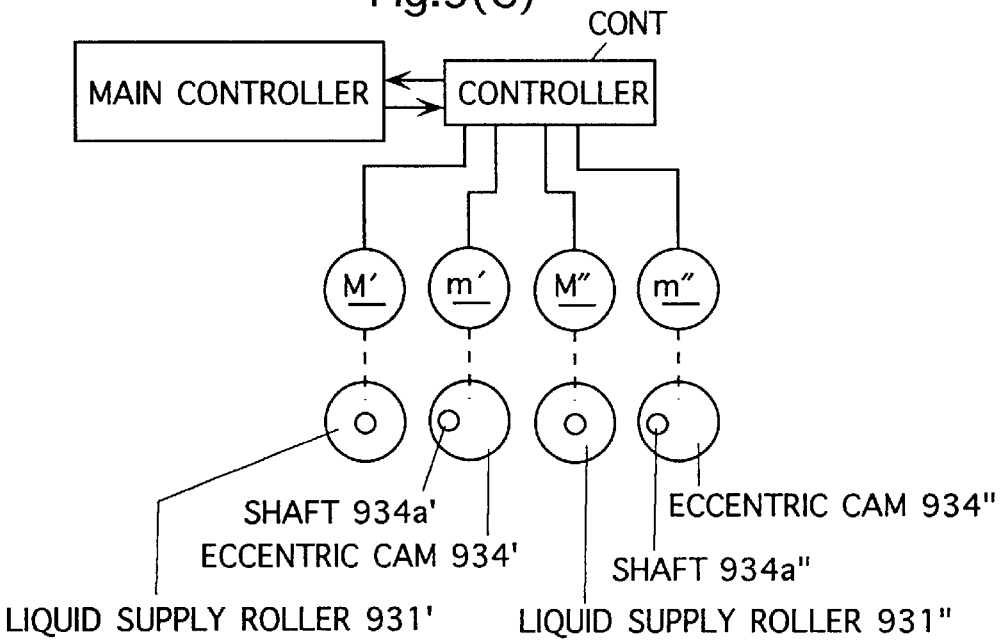

When both the transfer liquid application devices 9*d* and 9*e* are to be used in view of the kind of the record sheet S, both the blades 932' and 932" are spaced from the liquid supply roller 931' and 931" so that both the liquid supply rollers 931' and 931" supply the transfer liquid of the constant quantities to the application rollers 91' and 91", which apply the transfer liquid, of which quantities depends on the kind of the record sheet S, to the record sheet S, respectively (see also FIG. 3(C)).

FIG. 7 shows the state where the device 9*d* applies the transfer liquid E to the record sheet S, and the device 9*e* does not apply the transfer liquid E thereto.

In FIG. 7, 932*a*' and 932*a*" indicate pivots or support shafts of the blade, respectively, and 933' and 933" indicate springs pulling the blades, respectively. X' and X" indicate directions in which the springs pull the blades, respectively. FR1' and FR1" indicate stationary members to which the springs are coupled, respectively. 934*a*' and 934*a*" indicate shafts of the eccentric cams, respectively. P1' and P1" indicate transfer liquid restricting regions, P2' and P2" indicate regions where the liquid supply rollers supply the transfer liquid to the application rollers, respectively, and P3' and P3" indicate regions where the transfer liquid is applied to the record sheet, respectively.

Figure 8:
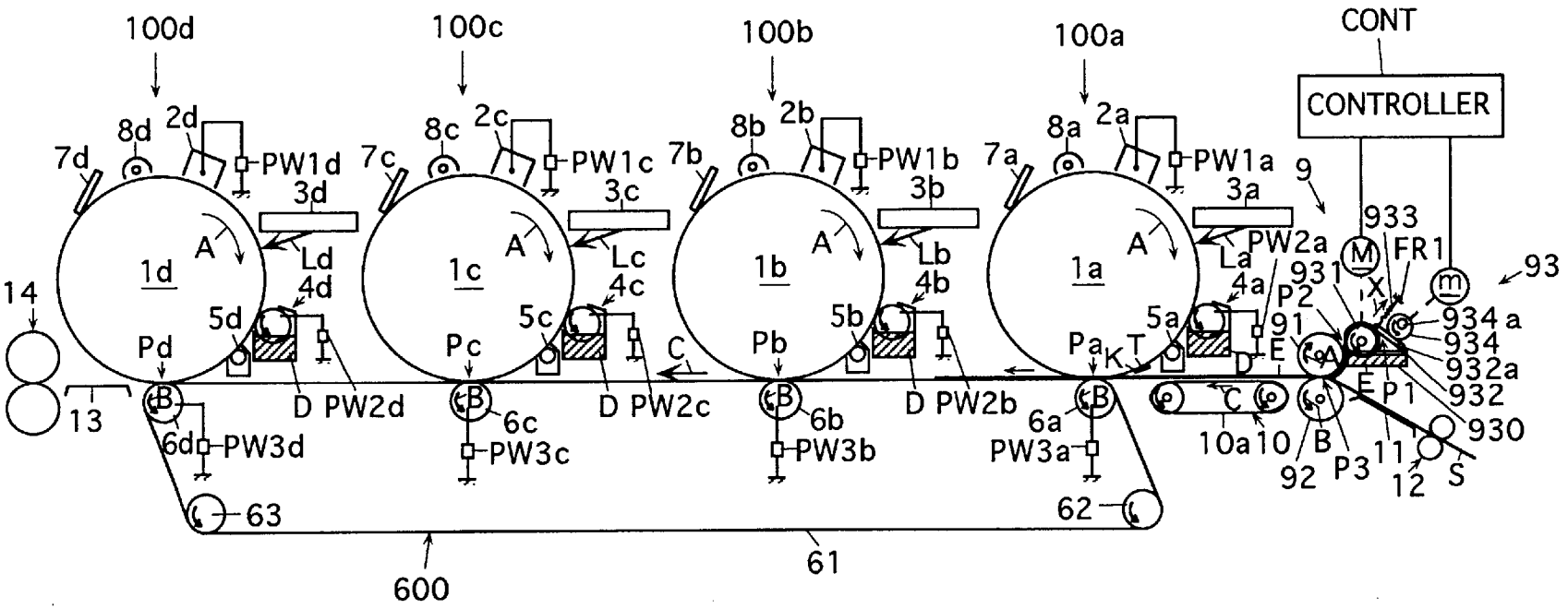
FIG. 8 shows a schematic structure of an example of a wet color image forming apparatus of a tandem type according to the invention.

FIG. 8 shows a schematic structure of another example of a wet image forming apparatus. This apparatus is a wet full color image forming apparatus of the so-called tandem type.

In this wet image forming apparatus, as shown in FIG. 8, portions 100*a*, 100*b*, 100*c* and 100*d* for forming and transferring visible toner images of different colors (cyan, magenta, yellow and black) are successively arranged in a constant direction.

The portions 100*a*, 100*b*, 100*c* and 100*d* for forming and transferring visible toner images are provided with photosensitive members 1*a*, 1*b*, 1*c* and 1*d*, respectively. Around the photosensitive members 1*a*, 1*b*, 1*c* and 1*d*, there are arranged main chargers 2*a*, 2*b*, 2*c* and 2*d*, exposure optical systems 3*a*, 3*b*, 3*c* and 3*d*, liquid developing devices 4*a*, 4*b*, 4*c* and 4*d*, squeeze rollers 5*a*, 5*b*, 5*c* and 5*d*, transfer rollers 6*a*, 6*b*, 6*c* and 6*d*, cleaning blades 7*a*, 7*b*, 7*c* and 7*d*, and discharging lamps 8*a*, 8*b*, 8*c* and 8*d* in this order, respectively. The photosensitive members 1*a*–1*d* are driven to rotate in the clockwise direction A in FIG. 8. The transfer rollers 6*a*–6*d* are opposed to the photosensitive members 1*a*–1*d* to form transfer portions Pa, Pb, Pc and Pd therebetween, respectively.

Under the transfer portions Pa–Pd, there are arranged transfer rollers 6*a*–6*d*, respectively. A tension roller 62 and a drive roller 63 are arranged under the transfer rollers 6*a*–6*d*. A transfer/transport device 600 is formed of these rollers 6*a*–6*d*, 62 and 63 as well as a transfer/transport belt 61 retained around these rollers. The transfer/transport belt 61 is driven in a direction C in the figure by the drive roller 63, and successively passes through the transfer portions Pa–Pd.

In the transfer/transport device 600, the transfer rollers 6*a*–6*d* can be supplied with transfer voltages from corresponding power sources PW3*a*, PW3*b*, PW3*c* and PW3*d*, whereby the toner images on the photosensitive members 1*a*–1*d* can be transferred onto the record sheet S, respectively. The record sheet S is electrostatically or mechanically held on the transfer/transport belt 61 by a holding device (not shown), and is transported in the direction C in the figure.

The exposure optical systems 3*a*, 3*b*, 3*c* and 3*d* can irradiate photosensitive members 1*a*, 1*b*, 1*c* and 1*d* with laser light La, Lb, Lc and Ld based on image information of cyan, magenta, yellow and black sent from an image reader (not shown) or the like, and thereby form electrostatic latent images corresponding to cyan, magenta, yellow and black images on the photosensitive members 1*a*, 1*b*, 1*c* and 1*d*, respectively.

The squeeze rollers 5*a*, 5*b*, 5*c* and 5*d* are in contact with the photosensitive members 1*a*, 1*b*, 1*c* and 1*d*, respectively, and are driven to rotate in the direction B. Thereby, surplus carrier liquid adhered onto the photosensitive members 1*a*, 1*b*, 1*c* and 1*d* can be reduced to predetermined quantities, respectively.

The photosensitive members 1*a*–1*d*, the main chargers 2*a*–2*d*, the exposure optical systems 3*a*–3*d*, the liquid developing devices 4*a*–4*d*, the squeeze rollers 5*a*–5*d*, the transfer rollers 6*a*–6*d*, the cleaning blades 7*a*–7*d* and the discharging lamps 8*a*–8*d* shown in FIG. 8 have the same structures and operations as the photosensitive member 1, the main charger 2, the exposure optical system 3, the liquid developing device 4, the squeeze roller 5, the transfer roller 6, the cleaning blade 7 and the discharging lamp 8, respectively. Structures other than the above are the same as those of the wet image forming apparatus shown in FIG. 1. More specifically, the transfer liquid application device 9, the timing roller pair 12 and others are arranged upstream to the most upstream toner image forming and transferring portion 100*a*. The fixing device 14 and others are arranged downstream from the most downstream toner image forming and transferring portion 100*d*. The same parts and portions bear the same reference numbers.

Description will now be given primarily on differences of the wet image forming apparatus shown in FIG. 8 with respect to the apparatus shown in FIG. 1.

In this wet image forming apparatus, the cyan visible toner image is formed on the photosensitive member 1*a* in the forming and transferring portion 100*a*.

The photosensitive member 1*a* is rotated and is uniformly charged by the main charger 2*a*.

Exposure is effected on the charged region with the laser light La emitted from the exposure optical system 3*a* so that the electrostatic latent image corresponding to the cyan image is formed. This electrostatic latent image moves to the liquid developing device 4*a* in accordance with rotation of the photosensitive member 1*a*.

In the liquid developing device 4*a*, the liquid developer is supplied to the electrostatic latent image formed on the photosensitive member 1*a* so that the latent image is developed into the visible toner image with the developing bias voltage applied thereto.

The visible toner image on the photosensitive member 1*a* as well as the carrier liquid, which remains after the surplus liquid was scraped off by the squeeze roller 5*a*, move to the transfer portion Pa.

The toner image moved to the transfer portion Pa is transferred onto the record sheet S. The record sheet is fed by the feed roller (not shown) from the sheet supply tray (not shown), and is sent to the timing roller pair 12. The timing roller pair 12 sends the record sheet S in synchronization with the toner image on the photosensitive member 1*a*. The record sheet S guided by the guide plate 11 moves to the transfer liquid application device 9.

In the transfer liquid application device 9, the transfer liquid E, of which quantity depends on the kind of the record sheet S, is applied to the record sheet S. Since the record sheet S absorbs the transfer liquid E thus applied, the record sheet S will not absorb or will hardly absorb the liquid thereafter.

After absorbing the transfer liquid, the record sheet S is transported by the transporting device 10 to the transfer portion Pa.

In the transfer portion Pa, the transfer roller 6*a* pushes the rear surface of the record sheet S through the transfer/transport belt 61 toward the photosensitive member 1*a*. The cyan toner image on the photosensitive member 1*a* comes into contact with the record sheet S. The toner image is attracted toward the belt 61 owing to application of the voltage from the power source PW3*a*, and is transferred onto the record sheet S. Since the record sheet S entering the transfer portion Pa has already absorbed the liquid, the record sheet S in the transfer portion Pa does not absorb or hardly absorb the carrier liquid adhered to the photosensitive member 1*a*.

The cleaning blade 7*a* removes the residual toner which was not transferred to the record sheet S and remains on the photosensitive member 1*a*. Thereafter, the discharging lamp 8*a* irradiates the photosensitive member 1*a* with light so that residual charges on the photosensitive member 1 are removed. Thereby, the photosensitive member 1*a* is ready for the next image formation.

The record sheet S further moves to the transfer portion Pb in accordance with movement of the transfer/transport belt 61.

In a similar manner, the magenta, yellow and black visible toner images on the photosensitive members 1*b*, 1*c* and 1*d* are successively transferred onto the record sheet S in the forming and transferring portions 100*b*, 100*c* and 100*d*, respectively, so that the visible images of the respective colors are superposed.

In this apparatus, the transfer liquid application device 9 applies the transfer liquid E, of which quantity depends on the kind of the record sheet S, to the record sheet S prior to the first transfer of the visible image onto the record sheet S. Therefore, the record sheet S does not absorb or hardly absorbs the carrier liquid K, which coexists with the toner image, in any of the first and subsequent transfer portions Pa, Pb, Pc and Pd. Accordingly, the carrier liquid K of the constant quantities may coexist with the toner image in the first and subsequent transfer portions Pa, Pb, Pc and Pd. Also, it is not necessary to give consideration to the order of the transfer of the toner images of the respective colors. Even in these cases, good transferred images can be produced by fast operations independently of the kinds of the record sheets S.

After transferring the toner image in the transfer portion Pd, the record sheet S guided by the guide plate 13 is sent to the fixing device 14, which fixes the toner images to the record sheet S. Thereafter, the record sheet S is discharged to the sheet discharge tray by the discharge roller pair.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

an image holding device for holding on its surface an image developed with liquid developer;

a record medium transporting device for transporting a record medium from a supply position to a transfer position for transferring the image developed on said image holding device onto a surface of said record medium;

a transfer agent supply device for supplying a transfer agent onto said surface of said record medium during transportation between said supply position and said transfer position; and a control device for controlling a quantity of the transfer agent supplied from said transfer agent supply device to said record medium in accordance with a property of said record medium determined in advance with respect to said record medium.

2. The image forming apparatus according to claim 1, wherein said transfer agent supply device includes an application roller for holding said transfer agent on its surface, and applying said transfer agent held thereon onto said record medium; and a transfer agent supply unit for supplying said transfer agent onto the surface of said application roller.

3. The image forming apparatus according to claim 1, wherein said transfer agent supply device includes an application roller for holding said transfer agent on its surface, and applying said transfer agent held thereon onto said record medium; a transfer agent supply roller for supplying said transfer agent onto the surface of said application roller; and a distance changing device for changing a distance between centers of said application roller and said supply roller based on an instruction sent from said control device.

4. The image forming apparatus according to claim 1, wherein said transfer agent supply device includes an application roller rotating together with said transfer agent held on its surface, and applying said transfer agent held thereon onto said record medium; a transfer agent supply roller spaced from said application roller by a predetermined distance, and rotating to supply said transfer agent onto the surface of said application roller; and a speed changing device for changing the relative surface speed between said application roller and said supply roller based on an instruction sent from said control device.

5. The image forming apparatus according to claim 1, wherein said transfer agent supply device includes an application roller rotating together with said transfer agent held on its surface, and applying said transfer agent held thereon to said record medium; a transfer agent supply roller spaced from said application roller by a predetermined distance, and rotating to supply said transfer agent onto the surface of said application roller; a transfer agent restricting member opposed to the surface of said supply roller; and a space changing device for changing a space between said supply roller and said restricting member based on an instruction sent from said control device.

6. The image forming apparatus according to claim 1, wherein said transfer agent supply device includes an application roller rotating together with said transfer agent held on its surface, and applying said transfer agent held thereon to said record medium; a transfer agent restricting member opposed to the surface of said application roller; and a space changing device for changing a space between said application roller and said restricting member based on an instruction sent from said control device.

7. The image forming apparatus according to claim 1, wherein the apparatus includes a plurality of transfer agent supply devices arranged at a plurality of positions between said record medium supply position and said transfer position, respectively.

8. The image forming apparatus according to claim 7, further comprising:

a control device for controlling a quantity of the transfer agent supplied from said plurality of transfer agent supply devices to said record medium in accordance with a property of said record medium already determined with respect to said record medium.

9. The image forming apparatus according to claim 1, wherein the apparatus includes a plurality of image holding devices arranged at a plurality of positions, respectively, and there is a transfer position corresponding to each of said image holding devices, said record medium transporting device is operable to pass said record medium successively through the plurality of transfer positions corresponding to said plurality of image holding devices, respectively, and said transfer agent supply device is arranged upstream, in a record medium transporting direction, to the most upstream transfer position.

10. The image forming apparatus according to claim 1, wherein the transfer agent is a same liquid as a liquid contained in the liquid developer.

11. The image forming apparatus according to claim 1, wherein the transfer agent has a viscosity that is similar to a viscosity of a liquid in the liquid developer.

12. The image forming apparatus according to claim 1, wherein the transfer agent is a surfactant.

13. An image forming apparatus comprising:

an image holding device for holding on its surface an image developed with liquid developer containing toner and medium liquid;

a record medium transporting device for transporting a record medium from a supply position to a transfer position for transferring the image developed on said image holding device onto a surface of said record medium;

a transfer agent supply device for supplying a transfer agent onto said surface of said record medium during transportation between said supply position of said record medium and said transfer position; and a control device for controlling a quantity of the transfer agent supplied from said transfer agent supply device to said record medium in accordance with a property of said record medium determined in advance with respect to said record medium.

14. The image forming apparatus according to claim 13, wherein said transfer agent supply device includes an application roller for holding said transfer agent on its surface, and applying said transfer agent held thereon onto said record medium; and a transfer agent supply unit for supplying said transfer agent onto the surface of said application roller.

15. The image forming apparatus according to claim 13, wherein said transfer agent supply device includes an application roller for holding said transfer agent on its surface, and applying said transfer agent held thereon onto said record medium; a transfer agent supply roller for supplying said transfer agent onto the surface of said application roller; and a distance changing device for changing a distance between centers of said application roller and said supply roller based on an instruction sent from said control device 16. The image forming apparatus according to claim 13, wherein said transfer agent supply device includes an application roller rotating together with said transfer agent held on its surface, and applying said transfer agent held thereon onto said record medium; a transfer agent supply roller spaced from said application roller by a predetermined distance, and rotating to supply said transfer agent onto the surface of said application roller; and a speed changing device for changing the relative surface speed between said application roller and said supply roller based on an instruction sent from said control device.

17. The image forming apparatus according to claim 13, wherein said transfer agent supply device includes an application roller rotating together with said transfer agent held on its surface, and applying said transfer agent held thereon to said record medium; a transfer agent supply roller spaced from said application roller by a predetermined distance, and rotating to supply said transfer agent onto the surface of said application roller; a transfer agent restricting member opposed to the surface of said supply roller; and a space changing device for changing a space between said supply roller and said restricting member based on an instruction sent from said control device.

18. The image forming apparatus according to claim 13, wherein said transfer agent supply device includes an application roller rotating together with said transfer agent held on its surface, and applying said transfer agent held thereon to said record medium; a transfer agent restricting member opposed to the surface of said application roller; and a space changing device for changing a space between said application roller and said restricting member based on an instruction sent from said control device.

19. The image forming apparatus according to claim 13, wherein the apparatus includes a plurality of transfer agent supply devices arranged at a plurality of positions between said record medium supply position and said transfer position, respectively.

20. The image forming apparatus according to claim 19, further comprising:

a control device for controlling a quantity of the transfer agent supplied from said plurality of transfer agent supply devices to said record medium in accordance with a property of said record medium already determined with respect to said record medium.

21. The image forming apparatus according to claim 13, wherein the apparatus includes a plurality of image holding devices arranged at a plurality of positions, respectively, and there is a transfer position corresponding to each of said image holding devices, said record medium transporting device is operable to pass said record medium successively through the plurality of transfer positions corresponding to said plurality of image holding devices, respectively, and said transfer agent supply device is arranged upstream, in a record medium transporting direction, to the most upstream transfer position.

22. The image forming apparatus according to claim 13, wherein the transfer agent is the same as the medium liquid.

23. The image forming apparatus according to claim 13, wherein the transfer agent has a same viscosity as the medium liquid.

24. The image forming apparatus according to claim 13, wherein the transfer agent is a surfactant.

* * * * *